US005651512A

United States Patent [19]

Sand et al.

[11] Patent Number: 5,651,512

[45] Date of Patent: Jul. 29, 1997

[54] MISSILE TRACKING SYSTEM WITH A THERMAL TRACK LINK

[75] Inventors: Richard J. Sand, Torrance; George L. Gaskell, East Manhattan Beach; Michael L. Wells, Newhall, all of Calif.

[73] Assignee: Hughes Electronics, Los Angeles, Calif.

[21] Appl. No.: 535,389

[22] Filed: Sep. 28, 1995

[51] Int. Cl.[6] ..... F41G 7/00; F42B 15/00

[52] U.S. Cl. ..... 244/3.11; 244/3.13; 244/3.14; 244/3.16

[58] Field of Search ..... 250/342; 244/3.11, 244/3.13, 3.14, 3.16

[56] References Cited

U.S. PATENT DOCUMENTS

| | | | |
|---|---|---|---|
| 4,060,830 | 11/1977 | Woolfson | 250/342 |
| 4,264,907 | 4/1981 | Durand, Jr. et al. | 244/3.16 |
| 4,424,943 | 1/1984 | Zwirn et al. | 244/3.11 |
| 4,634,271 | 1/1987 | Jano et al. | 244/3.13 |
| 5,042,743 | 8/1991 | Carney | 244/3.11 |
| 5,074,491 | 12/1991 | Tyson | 244/3.11 |
| 5,147,088 | 9/1992 | Smith et al. | 244/3.11 |
| 5,332,176 | 7/1994 | Wootton et al. | 244/3.11 |
| 5,345,304 | 9/1994 | Allen | 250/342 |

*Primary Examiner*—Michael J. Carone
*Assistant Examiner*—Theresa M. Wesson
*Attorney, Agent, or Firm*—Gordon R. Lindeen, III; Michael W. Sales; Wanda K. Denson-Low

[57] ABSTRACT

A closed-loop missile tracking system (10) employs a missile (12) with a thermal beacon (22) and an optical beacon (24). A target designator (40) defines a boresight from a missile firing location, such as an aircraft, to a target. The closed-loop missile tracking system (10) employs a first tracker (48) and a second tracker (64) with a forward looking infrared (FLIR) sensor (52) to track the displacement of the optical beacon (22) and thermal beacon (24) from the boresight. The first tracker (48) generates a first set of azimuth and elevation error signals. The second tracker (64) further includes a video demultiplexing interface (70) which transforms serial multiplexed video signals, which are output by the FLIR sensor (52) and contain a field with M rows and L columns of pixels, into a demultiplexed parallel video signal. A video thermal tracker (VTT) (58) selects the N adjacent horizontal rows of pixels and generates a second set of azimuth and elevation error signals therefrom. The VTT (58) selects at least one of the first set of error signals, the second set or a combination thereof to guide the missile (12).

16 Claims, 3 Drawing Sheets

MISSILE TRACKING SYSTEM WITH A THERMAL TRACK LINK

This invention was made with government support under Contract No. F04606-90-D0004 awarded by the Department of Air Force. The Government has certain rights in this invention.

BACKGROUND OF THE INVENTION

1. Technical Field

This invention relates to missile tracking systems and, more particularly, to a missile tracking system with two track links having distinct frequencies.

2. Discussion

Some missiles, such as tube-launched, optically-tracked, wire-guided (TOW) missiles, do not include on-board tracking electronics and therefore require the input of target tracking signals from remotely located tracking electronics. Such missile systems typically include a target designator which defines a boresight or line of sight (LOS) from a launching site to a target. When the missile is fired, the tracking electronics guide the missile down the boresight to the target using a closed-loop control strategy. In other words, as the missile moves away from the boresight defined by the target designator, the error signal generated by the tracking electronics increases proportionately. As the missile moves towards the boresight defined by the target designator, the error signal decreases proportionately.

For tracking purposes, some missiles generate an optical beacon at near-infrared wavelengths which is received by tracking electronics associated with the aircraft. Still other missiles employ radar tracking. The tracking electronics generate azimuth and elevation error signals by identifying the displacement of the missile from the boresight. The tracking electronics transform the error signals from the launching site coordinate system, such as an aircraft coordinate system, to the missile coordinate system. The tracking electronics amplify the error signals and transmit the error signals to the missile. This closed-loop control continues to guide the missile down the boresight until the missile hits the target.

Some targets, however, are protected by electro-optical jammers which transmit high intensity signals at near-infrared wavelengths. If the jamming signal has an amplitude higher than the amplitude of the beacon generated by the missile, the tracking electronics can be confused by the electro-optical jamming signal. If the jamming signal is successful, the tracking electronics will incorrectly identify the displacement of the missile relative to the boresight. As a result, the error signals generated by the tracking electronics are incorrect and the missile will be guided away from both the boresight and, more importantly, the target. Common battlefield conditions such as smoke also degrade the optical beacon generated by the missile and cause incorrect error signals to be generated by the tracking electronics.

Therefore, a missile system which reduces the effects of electro-optical jamming and/or battlefield conditions such as smoke is desirable.

As cuts in the military budget continue, competitive pressure increases to provide missile tracking systems with higher reliability and increased accuracy at lower cost. Therefore, a missile system which reduces the effects of electro-optical jamming and/or battlefield conditions such as smoke without substantially increasing the cost of the missile tracking system is also desirable.

SUMMARY OF THE INVENTION

A missile tracking system, according to the invention, for guiding a missile from a launching site to a target includes a missile with a controller connected to first and second beacon generators and a trajectory control means for controlling the trajectory of said missile. A designating means identifies a target and defines a boresight from said launching site to said target. A first tracking means generates a first error signal based on the position of a first beacon relative to said boresight. A second tracking means generates a second error signal based on the position of a second beacon relative to said boresight. An error signal selecting means, coupled to said first and second tracking means and said designating means, selects at least one of said first error signal, said second error signal, or a combination thereof to guide said missile.

According to another feature of the invention, the first tracking means is an optical track link operating at near-infrared wavelengths and the second tracking means is a thermal track link operating at far-infrared wavelengths.

According to another feature of the invention, the second tracking means further includes sensing means for generating serial multiplexed video signals of a field of view including said boresight and said second beacon. The serial multiplexed video signal of said field of view includes M horizontal rows and L columns of pixels. The pixels in said field of view are sequentially ordered in said serial multiplexed video signal in a column-by-column manner.

According to another feature of the invention, the second tracking means further includes interfacing means, coupled to said sensing means, for transforming said serial multiplexed video signal into a demultiplexed video signal.

According to another feature of the invention, the second tracking means further includes row selecting means, coupled to said interfacing means, for selecting N adjacent horizontal rows of pixels from said M horizontal rows of pixels in said field of view, wherein N is less than M.

According to another feature of the invention, the second tracking means further includes signal generating means, coupled to said row selecting means, for generating said second error signal from said N adjacent horizontal rows of pixels selected by said row selecting means.

According to another feature of the invention, the missile tracking system further includes coordinate transforming means having an input coupled to said error signal selecting means for transforming a selected error signal from a coordinate system associated with said launching site to a coordinate system associated with said missile.

In a further embodiment of the present invention, a missile tracking system for guiding a missile from a launch site to a target includes a missile with a controller connected to first and second beacon generating means for generating first and second beacons and a control means for controlling the trajectory of said missile. A designating means identifies a target and defines a boresight from said launching site to said target. A first tracking means generates a first error signal based on the position of said first beacon relative to said boresight. A second tracking means includes sensing means for generating serial multiplexed video signals of a field of view including said boresight and said second beacon. The serial multiplexed video signal includes M horizontal rows and L columns of pixels for said field which are sequentially ordered in a column-by-column manner. The second tracking means further includes an interfacing means, coupled to said sensing means, for transforming said serial multiplexed video signal into a demultiplexed video signal. The second tracking means generates a second error signal based on said demultiplexed video signal. An error signal selecting means, coupled to said first and second tracking means, selects at least one of said first error signal, said second error signal, or a combination thereof to guide said missile. A missile control means, coupled to said error signal selecting means, transmits guidance commands, related to said at least one of said first error signal, said second error signal, or said combination thereof, to direct said missile along said boresight.

Still other objects, features and advantages will be readily apparent from the specification, the drawings and the claims which follow.

DETAILED DESCRIPTION OF THE DRAWINGS

The various advantages of the present invention will become apparent to those skilled in the art after studying the following disclosure and by reference to the drawings in which.

DETAILED DESCRIPTION OF THE PREFERRED EMBODIMENTS

The present invention provides a second track link for tracking the missile if the primary track link is not operating properly due to electro-optical jamming electronics or battlefield conditions such as smoke. The secondary track link, such as a forward looking infrared (FLIR) sensor tracking a thermal beacon on the missile, is capable of tracking through battlefield conditions such as smoke and includes conventional algorithms to prevent jamming. A demultiplexing video interface transforms the serial multiplexed video signal output by the FLIR sensor into N selectable parallel channels suitable for input to a video thermal tracker.

Figure 1:
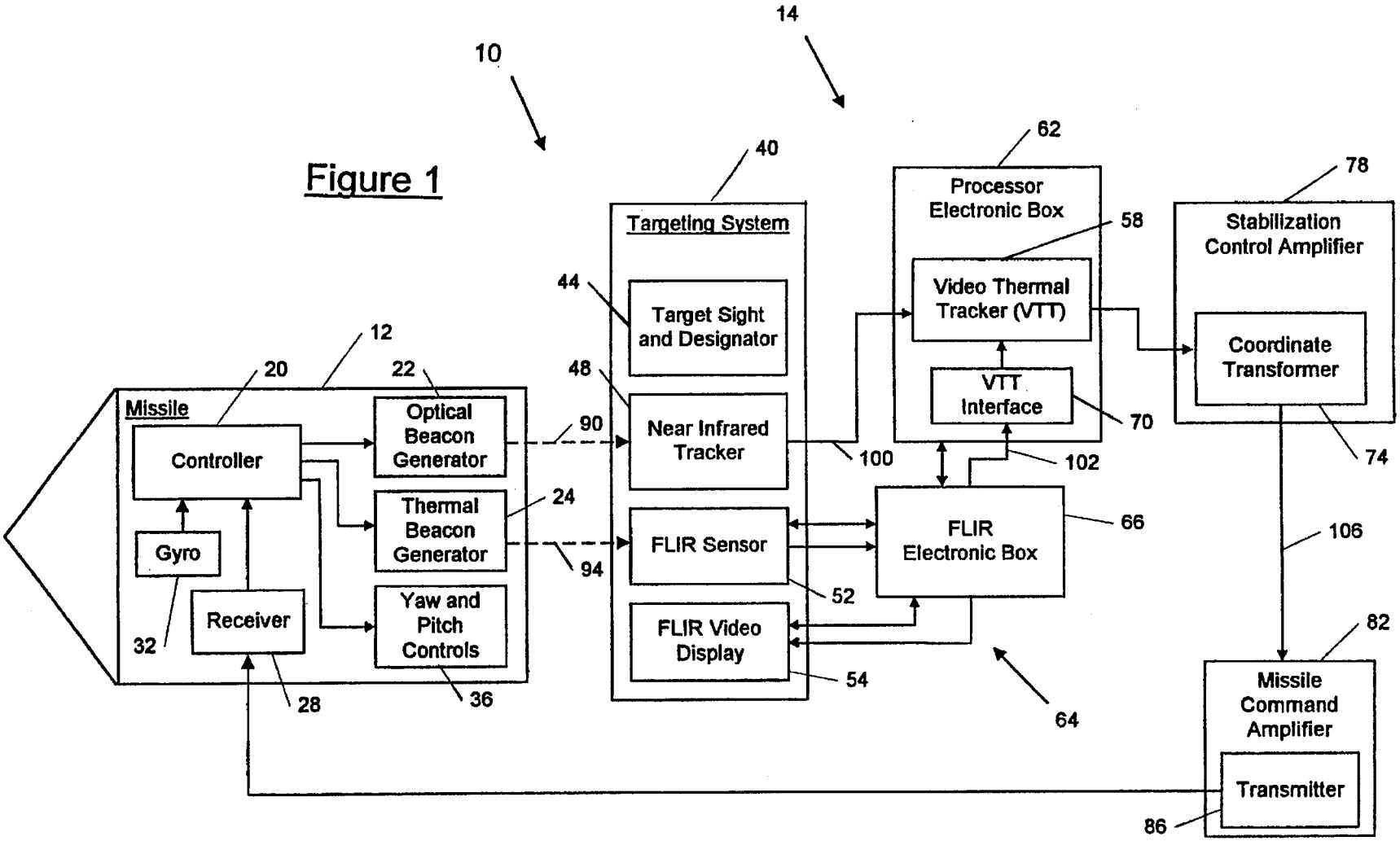
FIG. 1 is a simplified block diagram illustrating a closed-loop missile tracking system according to the present invention.

Referring to FIG. 1, a closed-loop missile tracking system 10 is illustrated and includes a missile 12 and tracking electronics 14. Missile 12 includes a controller 20 coupled to an optical beacon generator 22 and a thermal beacon generator 24. Controller 20 is also coupled to a gyroscope (gyro) 32, a receiver 28 and yaw and pitch controls 36. Controller 20 may include an input/output interface (not shown).

Tracking electronics 14 include a targeting system 40 with a target sight and designator 44, a near-infrared tracker 48, a forward looking infrared (FLIR) sensor 52 and video display 54. A first or near-infrared tracker 48 tracks optical beacon 90 and is coupled to a video thermal tracker (VTT) 58 which is associated with a processor electronic box (PEB) 62. A second or optical tracker 64 tracks thermal beacon 94. FLIR sensor 52 and video display 54 are coupled to FLIR electronic box (FEB) 66. FEB 66, in turn, is coupled to PEB 62 and a video multiplexing interface or a video thermal tracker (VTT) interface 70. VTT interface 70 is coupled to VTT 58. An output of VTT 58 is coupled to a coordinate transformer 74 of a stabilization control amplifier (SCA) 78. Coordinate transformer 74 is coupled to a missile command amplifier (MCA) 82 which includes a transmitter 86. While transmitter 86 and receiver 28 are illustrated, it can be appreciated that if wires connect the tracking electronics 14 and missile 12, transmitter 86 and receiver 28 can be omitted or replaced with input/output interfaces.

Tracking system 14 employs optical beacon generator 22 and thermal beacon generator 24 to track missile 12 and to generate error signals which are proportional to the displacement of the missile 12 from a boresight defined by target sight and designator 44 to the target. When the missile 12 is fired, controller 20 initializes a missile coordinate system and gyro 32 (so that the missile is roll stabilized). Likewise, SCA 78 initializes an aircraft coordinate system. Controller 20 activates optical generator 22 which begins transmitting an optical signal 90, preferably at near-infrared (0.9 micron) wavelengths. Likewise, controller 20 activates thermal beacon generator which transmits a thermal signal 94, preferably at far-infrared (10 micron) wavelengths.

The first tracker or near-infrared tracker 48 receives optical beacon 90 and generates azimuth and elevation error signals based upon the difference between the optical beacon and the boresight defined by the target sight and designator 44. The azimuth and elevation error signals are output via connection 100 to VTT 58. In prior missile control systems, the azimuth and elevation errors signals would then be output directly from near-infrared tracker 48 to coordinate transformer 74 of SCA 78. Video output from a FLIR sensor would not be used to generate the error signals.

According to the present invention, the second tracker 64 includes FLIR sensor 52 which senses thermal beacon 94 and generates serial multiplexed video which is output to FLIR electronic box 66. FLIR electronic box 66 generates two video signals. A first video signal is scan converted, preferably using an RS-170 format, for compatibility with video display 54. Because the first video signal is delayed an equivalent of one frame, (or 1/30 seconds), it is unsuitable for use with a closed-loop tracking system. Such a delay would cause significant tracking problems. FLIR electronic box 66 also provides a second video signal which is serial multiplexed and is a nonscan converted video signal (or pseudo video). The pseudo video signal is typically used with conventional imaging electronics such as a video scene tracker.

Preferably, the pseudo video signal is an analog serial multiplexed video signal having a peak voltage range from a −2.50 to +2.50 volts direct current (DC) and a pixel clock rate of 6.804 MegaHertz (MHz). The pseudo video signal is output via connection 102 to VTT interface 70. In a preferred embodiment, VTT interface 70 transforms the serial multiplexed pseudo video signal into a parallel video signal providing a minimum of 56 parallel channels of which a group of eight adjacent channels are selectable by the VTT 58 at one time. Preferably, thermal beacon generator 24 can be selectively switched on and off so that the thermal beacon can be accurately and distinctly identified from clutter.

VTT 58 generates a second set of azimuth and elevation error signals from the parallel scanned FLIR sensor video. Thus while the function of the first tracker is performed by near-infrared tracker 48 alone, the function of the second tracker is performed by FLIR sensor 52, FEB 66, VTT interface 70, and VTT 58.

VTT 58 performs the additional functions of selecting between the first set of azimuth and elevation error signals generated using the optical beacon 90 and near-infrared tracker 48 and the second set of azimuth and elevation error signals generated from the thermal beacon 94 and the second tracker 64. Preferably, VTT 58 can generate a hybrid set of azimuth and elevation error signals from a combination of the first and second sets of error signals. Coordinate transformer 74 translates the selected azimuth and elevation error signals output by VTT 58 from the aircraft coordinate system to the missile coordinate system and outputs yaw and pitch error signals via connection 106 to MCA 82. Transmitter 86 sends the yaw and pitch errors to receiver 28 of missile 12. Receiver 28, controller 20 and yaw and pitch controls 36 of missile 12 correct the missile trajectory.

VTT 58 selects between the first and second azimuth and elevation error signals or generates the hybrid set based on a quality factor associated with the first and second sets of azimuth and elevation error signals. The quality factor is determined by examination of the signal-to-noise ratio for each error signal. The signal-to-noise ratios are then related to a weighing factor that is assigned to the first and second azimuth and elevation error signals.

VTT 58 utilizes the azimuth and elevation error signals generated by near-infrared tracker 48 and optical beacon generator 22 unless the quality factor thereof drops below a predetermined threshold. In such a case, VTT 58 switches to the azimuth and elevation error signals generated by the thermal beacon 94 and FLIR 52, and VTT 58. In degraded conditions where both the near-infrared and thermal tracking are degraded due to smoke, dust, and/or other atmospheric effects, the near-infrared and thermal tracking error signals are summed together based on a weighing function assigned to each. If a jammer is detected, a hybrid set of error signals is not generated and either the near-infrared or the thermal sensor error signals are used alone.

When only the first and second sets of error signals are employed (without the hybrid set), the optical track link is considered the primary track link. It is monitored for its signal quality throughout the missile flight. If the quality of the optical track link is degraded due to electro-optical jamming measures or battlefield conditions such as smoke, missile tracking is transferred to the thermal track link. Since the missile is already flying down the boresight defined by the target designator 44, there is no step input to the closed-loop guidance system as the change is made between the first and second sets of error signals. Once the missile tracking is transferred to the thermal track link, the optical track link is no longer used for the remainder of the missile's flight.

The pseudo video signal output by FLIR sensor 52 is a serial multiplexed video signal. For example, assuming left to right scanning of the object scenes, the first pixel of the first row is followed by the first pixel of the second row, . . . , and the first pixel of the $M^{th}$ row. In other words, the pseudo video signal outputs the left-most column of pixels first. Then the second pixel of the first row is output and is followed by the second pixel of the second row, . . . , and the second pixel of the $M^{th}$ row. In other words, the pseudo video signal then outputs the second column of pixels (from the left). This sequence continues until the right-most column of the field is output. Note that the pseudo video signal may start with the right-most column first and end with the left-most column when the FLIR sensor 52 is scanning the object scene right to left.

Conventional VTT 58 require N adjacent channel video signal inputs where each channel video signal contains one horizontal row of pixels from the field (where N is less than M). In a preferred embodiment, M equals 120 and N equals 8. VTT interface 58 demultiplexes the pseudo video signal and allows the VTT to select the N adjacent channel video signals.

Figure 2:
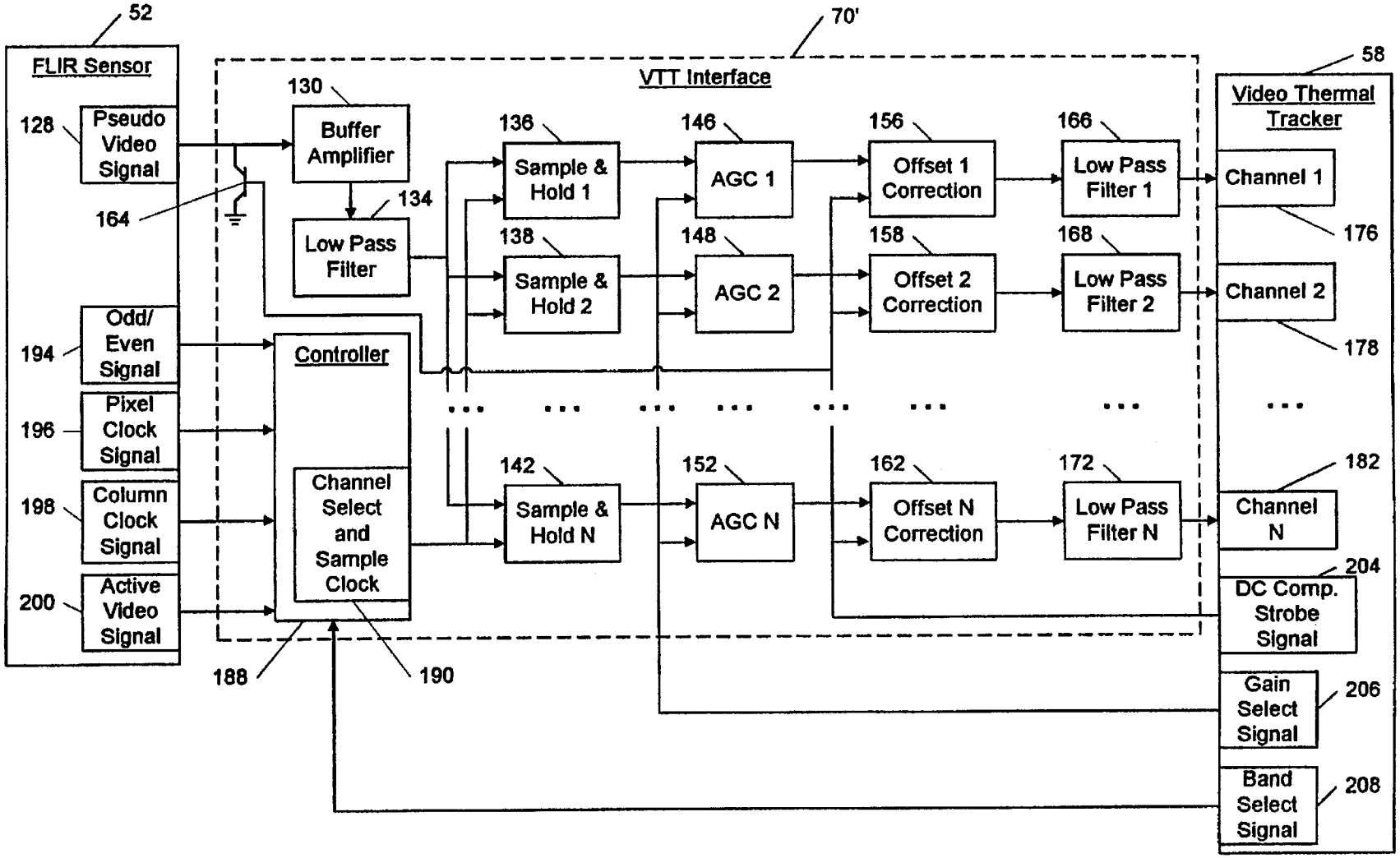
FIG. 2 illustrates a first embodiment of a video demultiplexing interface according to the present invention.

A first embodiment of a video demultiplexing interface or VTT interface 70' according to the present invention is illustrated in FIG. 2. FLIR sensor 52 generates the pseudo video signal at output 128 which is amplified by a differential buffer amplifier 130. Buffer amplifier 130 is coupled to a low pass filter 134 which, in turn, is connected to N sample and hold circuits 136, 138, . . . , and 142. An output of each of the N sample and hold circuits is coupled to an input of an automatic gain control (AGC) amplifier 146, 148, . . . , and 152. An output of each of the N AGC amplifiers is coupled to an input of an offset correction amplifier 156, 158, . . . , and 162. An output of each of the N offset correction amplifiers is coupled to an input of a low pass filter 166, 168, . . . , and 172. Outputs of each of the N low pass filters are coupled to N channels 176, 178, . . . , 182. As can be appreciated by skilled artisans, FIG. 2 illustrates N sample and hold circuits. For example, in a preferred embodiment, eight sample and hold circuits are employed. Therefore in this example N equals eight. It should be understood that the third through the seventh sample and hold circuits are represented by symbols " . . . " in FIG. 2. This same designation is employed FIG. 2 for the AGC, offset correction, and low pass filter circuits.

VTT interface 70' further includes a controller 188 having a channel select output and a sample clock output at 190 which is coupled to a second input of each of the N sample and hold circuits 136, 138, . . . , and 142. FLIR sensor 52 includes a plurality of control outputs which are coupled to an input of control logic circuit 188. The control outputs include an odd/even signal 194, a pixel clock signal 196, a column clock signal 198, and an active video signal 200. VTT 58 includes several control outputs including a DC compensation strobe signal 204 which is coupled to a second input of each of the N offset correction amplifiers 156, 158, . . . , and 162. A gain select signal 206 of the VTT 58 is coupled to a second input of each of the N AGC amplifiers 146, 148, . . . , and 152. A band select signal 208 of VTT 58 is coupled to an input of controller 188.

In use, the pseudo video signal 128 output by FLIR sensor 52 is input to and amplified by differential buffer amplifier 130. The output of buffer amplifier 130 is routed through low pass filter 134 to minimize noise in the video signal. Preferably, low pass filter 134 has a cutoff frequency of 9.3 MHz. A channel select signal and a sample clock signal 190 and the filtered pseudo video signal are coupled to first and second inputs of the N sample and hold circuits 136, 138, . . . , and 142.

The serial multiplexed pseudo video signal 128 output by FLIR sensor 52 contains successive fields. Each field is defined by a plurality of pixels in M horizontal rows and L columns. The serial multiplexed pseudo video signal output by FLIR sensor 52 includes pixels arranged serially in a column by column manner. The pseudo video signal must be demultiplexed into parallel rows of pixels so that VTT 58 can select N horizonal rows of the M horizontal rows in a field (where N is less than M). VTT 58 requires parallel input of the select N horizontal rows.

To that end, the controller 188 triggers sample and hold circuit 136 to select a first designated pixel from a first column. The next sample and hold circuit 138 selects the second designated pixel from the same column and the next row. The Nth sample and hold circuit 142 selects the Nth designated pixel from the same column. Column clock 198 signals a new column and the process is repeated for each of the L columns of the field.

Software associated with controller 188 and/or VTT 58 periodically monitors a field for a peak pixel signal and adjusts the gain for the field based on the peak. In a preferred embodiment, the peak pixel signal is measured for each field. VTT 58 outputs the gain via gain select signal 206. Thus the gain of each pixel of a field is adjusted uniformly. In other words, the eight sample and hold circuits 136, 138, . . . , 142 output N adjacent horizontal rows, one pixel at a time. AGC 146, 148, . . . , and 152 optimize the amplitude of the pixels with respect to a predetermined threshold level based on a peak pixel amplitude. VTT 58 generates gain select signal 206 which controls the gain provided by AGC 146, 148, . . . , and 152.

To minimize the effects of direct current (DC) offset during high gain operation, offset correction amplifiers 156, 158, . . . , and 162 are employed. Periodically, the input to buffer amplifier 130 is shorted with switch 164 and the DC offset in each of the N channels is sampled and stored. When switch 164 opens, the stored DC offset compensation values are summed with the associated channel's video signal. The DC compensation strobe signal 204 defines the timing for the DC offset compensation function. Preferably switch 164 is a field effect transistor (FET).

The output of each of the N offset correction amplifiers 156, 158, . . . , and 162 is coupled an input of low pass filters 166, 168, . . . , and 172. Preferably, low pass filters 166, 168, . . . , and 172 have a cutoff frequency of 7.6 kHz. Low pass filters 166, 168, . . . , and 172 optimize the signal to noise ratio while maintaining an optimum spread function for a point source. A higher cut-off frequency would provide minimum distortion to the true signal, but would permit more noise to be present thus lowering the signal-to-noise ratio. A lower cut-off frequency would improve the signal-to-noise ratio, but also would result in an unacceptable loss in the peak energy of the true signal. The image of a point in object space can be equated to an energy mountain and effects on this image can be evaluated using mathematical expressions for a point spread function.

Controller 188 controls the operation of VTT interface 70' and receives four control signals from FLIR sensor 52 and a band select signal from VTT 58. The odd/even signal 194 is a logic signal that provides the column scan direction, left-to-right or right-to-left. The active video signal 200 is a logic signal that is true whenever the video in each field is valid. The column clock signal 198 is a logic timing signal whose transition to the low state determines the timed location of each valid video column. The pixel clock signal 196 is a logic timing signal that indicates the timed location in each video column where the data for each video pixel is valid.

After the entire field is input and is routed through the channels, the output of each of the N low pass filters 166, 168, . . . , and 172 represents one channel of video that is required for input to VTT 58 for missile tracking.

VTT 58 includes a multiplexer (not shown) coupled to an analog to digital (A/D) converter (not shown) which converts the N-channel analog video signal to an N-channel digital video signal. A direct memory accessing or addressing (DMA) processor (not shown) inputs the N-channel digital video signal directly in the VTT memory.

As can be appreciated, video interface 70' demultiplexes the pseudo video output by FLIR sensor 52 and allows VTT 58 to select N of the M horizontal rows of pixels. As a result, VTT 58 can be used to generate a second set of azimuth and elevation error signals and to select between the first and second sets (or a hybrid thereof) of azimuth and elevation error signals.

The second thermal tracking link prevents the loss of a missile when successful electro-optical jamming overrides the primary optical tracking link or when battlefield conditions such as smoke degrade the primary optical tracking link. The thermal tracking link is generally not affected by typical battlefield smoke. Conventional algorithms can successfully prevent jamming the thermal track link. By formatting the pseudo video signal output by FLIR sensor 52 to a conventional VTT format, existing FLIR sensor and VTT technology can be employed with modest modifications.

Figure 3:
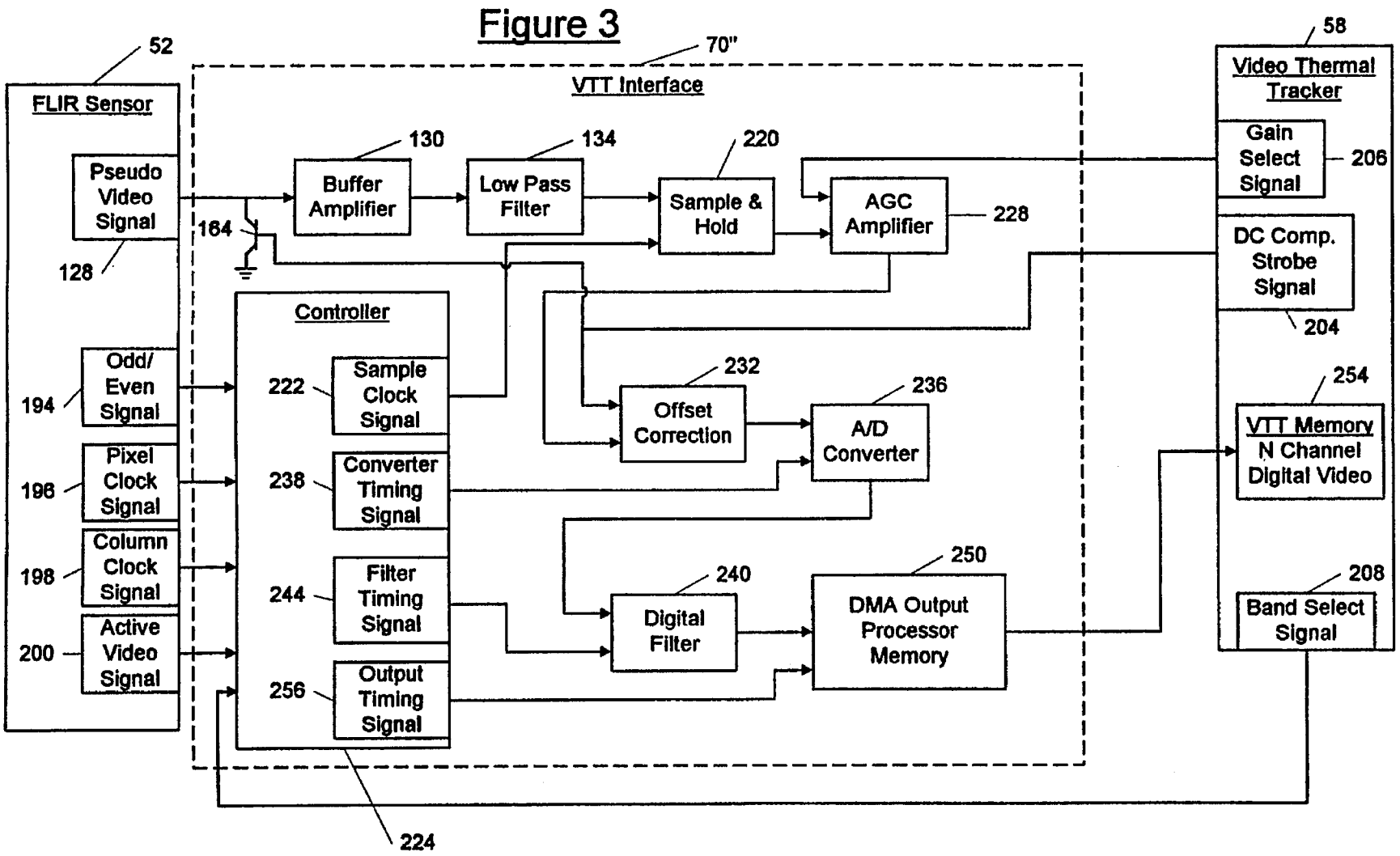
FIG. 3 illustrates a second embodiment of a video demultiplexing interface according to the present invention.

A second video demultiplexing interface or VTT interface 70" is illustrated in FIG. 3. For purposes of clarity, reference numerals from FIG. 2 will be used in FIG. 3 where appropriate. VTT interface 70" includes a sample and hold circuit 220 having one input coupled to an output of low pass filter 134 and second input coupled to a sample clock 222 of controller 224. A gain select output 206 of VTT 58 is coupled to a first input of an automatic gain control (AGC) amplifier 228 and a second input is coupled to an output of sample and hold circuit 220. An output of AGC amplifier 228 is coupled to a first input of an offset correction amplifier 232. A second input of offset correction amplifier 232 is coupled to DC comp strobe 204 of VTT 58.

An output of offset correction amplifier 232 is coupled to a first input of analog to digital (A/D) converter 236. A second input of A/D converter 236 is coupled to a converter timing output 238 of controller 224. An output of A/D converter 236 is coupled to a first input of digital filter 240. A second input of digital filter 240 is coupled to a filter timing output 244 of controller 224. An output of digital filter 240 is coupled to an input of direct memory accessing or addressing (DMA) output processor 250 which transfers the digital filtered video data directly to VTT memory 254.

Controller 224 sets timing and otherwise controls the operation of VTT interface 70". Controller 224 receives four control signals from FLIR sensor 52 and band select signal 208 from VTT 58. Each of the control signals from FLIR sensor 52 and VTT 58 operate in a manner similar to the first embodiment illustrated in FIG. 2.

In use, the pseudo video signal output by FLIR sensor 52 is input into and amplified by differential buffer amplifier 130. Low pass filter 134 minimizes noise in the pseudo video signal. The filtered video and a sample clock output 222 are coupled to sample and hold circuit 220 which ensures that the serial video output thereof represents only valid pixel data. AGC amplifier 228 optimizes the serial video amplitude with respect to a fixed video threshold level in a manner similar to the first embodiment of FIG. 2. To that end, VTT 58 generates a gain select control signal 206 for AGC amplifier 228 as previously described.

To minimize the effects of DC offset during high gain operation, an offset correction amplifier 232 is used. Periodically, the input to the buffer amplifier is shorted with switch 164 and the DC offset caused by high gain operation of buffer amplifier 130, low pass filter 134, sample and hold circuit 220, and AGC 228, is sampled and stored. When the switch 164 opens, the stored DC offset compensation values are summed with the serial video. The timing signal for the DC offset compensation function is defined by the DC comp strobe 204 and is generated by VTT 58.

The serial video output from the offset correction amplifier 232 along with a converter timing signal 238 are coupled to inputs of A/D converter 236. The output of the A/D converter 236 is preferably a multi-bit serial digital signal. The output of A/D converter 236 and a video band select signal are routed to digital filter 240. Digital filter 240 inputs the serial digital video into each of the N selected video channels and recursively filters the video data therein. Video outside the selected N channels is ignored. The band select signal 208 determines which N adjacent channels of the M video channels are to be processed. Digital filter 240 defines a 3 decibel (dB) cutoff frequency for each of the selected video channels. Preferably the cutoff frequency is 7.4 kHz. Digital filter 240 further provides a maximum signal to noise ratio while maintaining an optimum spread function for a point source.

An output timing signal 256 and the output of digital filter 240 are input to DMA output processor 250. DMA output processor 250 provides the control necessary to take the processor of VTT 58 off line and to transfer the digital filtered video data directly to VTT memory 254. After video data in each of the selected N channels is recursively filtered, it is output directly to the VTT processor memory 254. The video data from each of the N selected channels is transferred sequentially to VTT processor memory 254. The video from the remaining M-N channels is ignored. Preferably, M equals 120 and N equals 8.

In a highly preferred embodiment, tracking system 10 consists of a standard M65 system with a FLIR sensor and a laser target designator added to an M65 telescopic sight unit. The standard M65 system is manufactured by Hughes Aircraft and the night targeting system upgrades to the M65 telescopic sight unit are manufactured by TAMAM, a division of Israel Aircraft Industries, or Kollsman, a division of Sequa Corporation. Preferably the missiles employed are tube-launched, optically-tracked, wire-guided (TOW) missiles having both thermal and optical beacons.

As can be appreciated from the forgoing, the missile tracking system according to the present invention provides two track links for tracking a missile. If the primary track link is not operating properly due to battlefield conditions such as smoke or electro-optical target jamming electronics, a secondary link can be employed to properly guide the missile to the target. A secondary track link, such as the FLIR sensor tracking the thermal beacon, can track through battlefield conditions such as smoke and may be used with conventional algorithms to prevent jamming. VTT interface, according to the invention, transforms analog serial multiplexed video signals into N parallel channels which can be selected by and input to a VTT.

Various other advantages of the present invention will become apparent to those skilled in the art after having the benefit of studying the foregoing text and drawings, taken in conjunction with the following claims.

What is claimed:

1. A missile tracking system for guiding a missile from a launching site to a target, comprising:

a missile including a controller connected to first and second beacon generators and a trajectory control means for controlling the trajectory of said missile;

designating means for identifying a target and for defining a boresight from said launching site to said target;

first tracking means, coupled to said designating means, for generating a first error signal based on the position of a first beacon relative to said boresight;

second tracking means, coupled to said designating means, for generating a second error signal based on the position of a second beacon relative to said boresight; and error signal selecting means, coupled to said first and second tracking means, for selectively combining said first and second error signals to guide said missile.

2. The missile tracking system of claim 1 wherein said first tracking means is an optical track link operating at near-infrared wavelengths.

3. The missile tracking system of claim 1 wherein said second tracking means is a thermal track link operating at far-infrared wavelengths.

4. The missile tracking system of claim 1 wherein said second tracking means comprises:

sensing means for generating serial multiplexed video signals of a field of view including said boresight and said second beacon.

5. The missile tracking system of claim 4 wherein said serial multiplexed video signal of said field of view includes M horizontal rows and L columns of pixels.

6. The missile tracking system of claim 5 wherein said pixels in said field of view are sequentially ordered in said serial multiplexed video signal in a column-by-column manner.

7. The missile tracking system of claim 4 wherein said second tracking means further comprises:

interfacing means, coupled to said sensing means, for transforming said serial multiplexed video signal into a demultiplexed video signal.

8. The missile tracking system of claim 7 wherein said second tracking means further comprises:

row selecting means, coupled to said interfacing means, for selecting N adjacent horizontal rows of pixels from said M horizontal rows of pixels in said field of view, wherein N is less than M.

9. The missile tracking system of claim 8 wherein said second tracking means further comprises:

signal generating means, coupled to said row selecting means, for generating said second error signal from said N adjacent horizontal rows of pixels selected by said row selecting means.

10. The missile tracking system of claim 1 wherein said first and second error signals include azimuth and elevation components.

11. The missile tracking system of claim 9 further comprising:

coordinate transforming means having an input coupled to said error signal selecting means for transforming a selected error signal from a coordinate system associated with said launching site to a coordinate system associated with said missile.

12. A missile tracking system for guiding a missile from a launch site to a target, comprising:

a missile including a controller connected to first and second beacon generating means for generating first and second beacons and a control means for controlling the trajectory of said missile;

designating means for identifying a target and for defining a boresight from said launching site to said target;

first tracking means, coupled to said designating means, for generating a first error signal based on the position of said first beacon relative to said boresight;

second tracking means, coupled to said designating means, including sensing means for generating serial multiplexed video signals of a field of view including said boresight and said second beacon, said serial multiplexed video signal including M horizontal rows and L columns of pixels for said field which are sequentially ordered in a column-by-column manner, and interfacing means, coupled to said sensing means, for transforming said serial multiplexed video signal into a demultiplexed video signal, said second tracking means for generating a second error signal based on said demultiplexed video signal; and error signal selecting means, coupled to said first and second tracking means, for selecting at least one of said first error signal, said second error signal, or a combination thereof to guide said missile.

13. The missile tracking system of claim 12 wherein said demultiplexed video signal contains data defining the position of said second beacon relative to said boresight.

14. The missile tracking system of claim 12 wherein said second tracking means further comprises:

row selecting means, coupled to said interfacing means, for selecting N adjacent horizontal rows of pixels from said M rows of pixels in said field of view, wherein N is less than M.

15. The missile tracking system of claim 14 wherein said second tracking means further comprises:

signal generating means, coupled to said row selecting means, for generating said second error signal from said N selectable adjacent horizontal rows of pixels selected by said row selecting means.

16. A missile tracking system for guiding a missile from a launch site to a target, comprising:

a missile including a controller connected to first and second beacons and a control means for controlling the trajectory of said missile;

designating means for identifying a target and for defining a boresight from said launching site to said target;

first tracking means, coupled to said designating means, for generating a first error signal based on the position of said first beacon relative to said boresight;

second tracking means, coupled to said designating means, including sensing means for generating serial multiplexed video signals of a field of view including said boresight and said second beacon, said serial multiplexed video signal including M horizontal rows and L columns of pixels for said field which are sequentially ordered in a column-by-column manner, interfacing means, coupled to said sensing means, for transforming said serial multiplexed video signal into a demultiplexed video signal which defines the position of said second beacon relative to said boresight, and row selecting means, coupled to said interfacing means, for selecting N adjacent rows of pixels from said M rows of pixels in said field of view, said second tracking means for generating a second error signal by determining the displacement of said second beacon from said boresight using said N adjacent horizontal rows of pixels; and error signal selecting means, coupled to said first and second tracking means, for selecting at least one of said first error signal, said second error signal, or a combination thereof to guide said missile.

* * * * *